US007315709B2

(12) United States Patent
Kim et al.

(10) Patent No.: US 7,315,709 B2
(45) Date of Patent: Jan. 1, 2008

(54) IMAGE FORMING APPARATUS HAVING MAIN AND SUB-IMAGE FORMING UNITS AND METHOD OF USING APPARATUS

(75) Inventors: Young-min Kim, Suwon-si (KR); Byung-sun Ahn, Suwon-si (KR); Sang-cheol Park, Suwon-si (KR)

(73) Assignee: Samsung Electronics, Co., Ltd., Suwon-si, Gyeonggi-do (KR)

( * ) Notice: Subject to any disclaimer, the term of this patent is extended or adjusted under 35 U.S.C. 154(b) by 248 days.

(21) Appl. No.: 10/858,200

(22) Filed: Jun. 2, 2004

(65) Prior Publication Data

US 2005/0100362 A1 May 12, 2005

(30) Foreign Application Priority Data

Nov. 6, 2003 (KR) ..... 10-2003-0078285

(51) Int. Cl.
*G03G 15/00* (2006.01)

(52) U.S. Cl. ..... 399/110; 399/391

(58) Field of Classification Search ..... 399/107, 399/110, 111, 411, 388, 391; 271/9.01, 9.11
See application file for complete search history.

(56) References Cited

U.S. PATENT DOCUMENTS 4,587,532 A * 5/1986 Asano ..... 346/134
4,972,236 A * 11/1990 Hasegawa ..... 399/16
5,049,946 A * 9/1991 Harada ..... 399/110
5,150,167 A * 9/1992 Gonda et al. ..... 399/16
5,162,845 A * 11/1992 Ariyama et al. ..... 399/13
5,208,612 A * 5/1993 Obu et al. ..... 347/152
5,208,640 A * 5/1993 Horie et al. ..... 399/110

(Continued)

FOREIGN PATENT DOCUMENTS

JP 08208052 A * 8/1996

(Continued)

OTHER PUBLICATIONS

Korean Office Action dated Aug. 24, 2005, no translation.

*Primary Examiner*—Robert Beatty
(74) *Attorney, Agent, or Firm*—Roylance, Abrams, Berdo & Goodman, L.L.P.

(57) ABSTRACT

An image forming apparatus and method are disclosed. The image forming apparatus and method comprise a main image forming apparatus having a developing section and capable of being independently driven so that it prints an image onto a paper fed on the basis of input image information; at least one sub-image forming apparatus removably mounted to the main image forming apparatus in sequence, the sub-image forming apparatus having a developing section and modularized to perform printing operation according to a control command. The apparatus and method further comprise a main paper feeding unit connected to the main image forming apparatus and feeding a paper to the main image forming apparatus; at least one sub-paper feeding units removably connected to the main paper feeding unit in sequence for feeding a paper to the sub-image forming apparatus, respectively; and a control section for selectively controlling the operation of respective image forming apparatuses and respective paper feeding units on the basis of input image information in a manner that printing operations are performed either in one image forming apparatus or simultaneously in the respective image forming apparatuses.

22 Claims, 4 Drawing Sheets

U.S. PATENT DOCUMENTS 5,253,028 A * 10/1993 Gonda et al. ..... 399/124
5,669,040 A 9/1997 Hisatake
5,810,353 A 9/1998 Baskette et al. ..... 271/305
5,940,186 A * 8/1999 Barry et al. ..... 358/296
6,397,028 B1 5/2002 Nakamura ..... 399/124
6,973,286 B2 * 12/2005 Mandel et al. ..... 399/391

FOREIGN PATENT DOCUMENTS

KR 100288289 5/2001
KR 2002278186 9/2002

* cited by examiner

IMAGE FORMING APPARATUS HAVING MAIN AND SUB-IMAGE FORMING UNITS AND METHOD OF USING APPARATUS

CROSS-REFERENCE TO RELATED APPLICATIONS

This application claims the benefit under 35 U.S.C. § 119(a) of Korean Application No. 2003-78285, filed Nov. 6, 2003, in the Korean Intellectual Property Office, the entire contents of which is incorporated herein by reference.

BACKGROUND OF THE INVENTION

1. Field of the Invention

The present invention relates to an image forming apparatus and method. In particular, the present invention relates to an image forming apparatus and method for simultaneously performing a plurality of printing operations with a plurality of developing sections.

2. Description of the Related Art

Image forming apparatuses such as printers, copying machines, and so on typically comprise a paper cassette for feeding paper, a developing unit for developing an image on the paper fed from the paper cassette, a fusing unit for affixing the developed image onto the paper, and a discharge unit for discharging the paper on which the image is fused.

Most of the image forming apparatuses, which are on the market at present, take the form of a single modularized image forming apparatus comprising the previously described components. Image forming apparatuses can be used in networks with a plurality of personal computers (PCs). The image forming apparatuses normally have a single printing module and are networked with the plurality of PCs to perform printing operations in sequence based on the first to request a print job.

Accordingly, when a large number of PCs connected to the image forming apparatus concurrently transmit print data, the print waiting time is increased because the image forming apparatus is limited by its printout speed.

If the capacity of the paper feeding cassette is not sufficient, the cassette needs to be replenished with paper frequently. However, to avoid frequent replenishment, one or more paper feeding cassettes can be added. However, additional paper feeding cassettes do not increase the printout speed of the image forming apparatus.

Therefore, in order to cope with a large quantity of print jobs, it is required either to buy an expensive image forming apparatus that performs printouts at a relatively high speed or to install two or more image forming apparatuses. However, both options are expensive.

SUMMARY OF THE INVENTION

An object of the present invention is to solve at least the above problems and disadvantages and to provide at least the advantages described below. Accordingly, an object of the present invention is to provide an improved image forming apparatus and method, in which modularized image forming apparatuses can be selectively accessed to perform printing, thereby increasing a printout speed of the image forming apparatus.

In order to achieve the above object, there is provided an image forming apparatus and method comprising a main image forming apparatus having a developing section and capable of being independently driven in such a manner that it prints an image onto a paper fed on the basis of input image information; at least one sub-image forming apparatus removably connected to the main image forming apparatus in sequence, the sub image forming apparatus being provided with a developing section and modularized to perform printing according to a control command. The apparatus and method further comprise a main paper feeding unit connected to the main image forming apparatus for feeding a paper to the main image forming apparatus; at least one sub-paper feeding unit removably connected to the main paper feeding unit in sequence and feeding a paper to the sub-image forming apparatus, respectively; and a control section for selectively controlling the operation of respective image forming apparatuses and respective paper feeding units on the basis of input image information in such a manner that printing operations are performed either only in one image forming apparatus or simultaneously in the respective image forming apparatuses.

According to an embodiment of the present invention, the main image forming apparatus comprises a main paper path provided a predetermined distance from the developing section, so that printing can be performed on a paper fed from the main paper feeding unit; and a sub-transfer path for guiding a paper fed from a sub paper feeding unit for transfer to the sub image forming apparatus.

The sub transfer path is provided to pass through the top and bottom of the main image forming apparatus.

Furthermore, the at least one sub-image forming apparatus is stacked on the top of the main image forming apparatus in sequence.

According to an aspect of the present invention, the sub-image forming apparatus and method comprise a first transfer path provided to guide a paper fed from the sub-paper feeding unit, so that the paper passes through the developing appliance; a second transfer path for transferring a paper fed from the sub-paper feeding unit to another sub-image forming apparatus. The apparatus and method further comprise a guide member at a junction between the first transfer path and the second transfer path for selectively determining the transfer direction of the paper being transferred.

In addition, the second transfer path is preferably provided to pass through the top and bottom of the sub-image forming apparatus.

Furthermore, the at least one sub-paper feeding unit may be stacked under the main paper feeding unit in sequence.

According to another embodiment of the present invention, each of the main paper feeding unit and sub-paper feeding unit comprises a paper feeding tray including a paper receiving space loaded with papers; a pick-up unit located at the bottom of the paper feeding tray to pick up a paper from the paper feeding unit installed at a relatively lower place; and a paper path vertically connected to the paper feeding tray so as to guide a paper picked up from the paper feeding tray located at the relatively lower place.

The paper path may be connected to the sub-transfer path of the main image forming apparatus.

According to still another embodiment of the present invention, the image forming apparatus and method may further comprise a first alignment unit for determining a connection position between the sub-image forming apparatus and a predetermined neighboring image forming apparatus; and a second alignment unit for determining a connection position between the sub-paper feeding unit and a predetermined neighboring paper feeding unit.

Preferably, the first alignment unit comprises a first positioning means formed to be prominent a or depressed on the top and bottom surfaces of the sub-image forming apparatus;

and a second positioning means formed to be prominent or depressed on the top and bottom surfaces of a predetermined image forming apparatus connected to the sub-image forming apparatus so that it can be complimentarily engaged with the first position means.

In addition, the second alignment unit comprises a third positioning means formed be prominent or depressed on each of the top and bottom surfaces of the sub-paper feeding unit; and a fourth positioning means formed to be prominent or depressed on the top or bottom surface of a predetermined paper feeding unit connected to the sub-paper feeding unit so that it can be complimentarily engaged with the third positioning part.

BRIEF DESCRIPTION OF THE DRAWINGS

The above and other objects, features and advantages of the present invention will be more apparent from the following detailed description taken with reference to the accompanying drawings, in which.

In the drawings, it should be understood that like reference numbers refer to like features and structures.

DETAILED DESCRIPTION OF THE PREFERRED EMBODIMENTS

Embodiments of the present invention will be described in detail with reference to the accompanying drawings.

Figure 1:
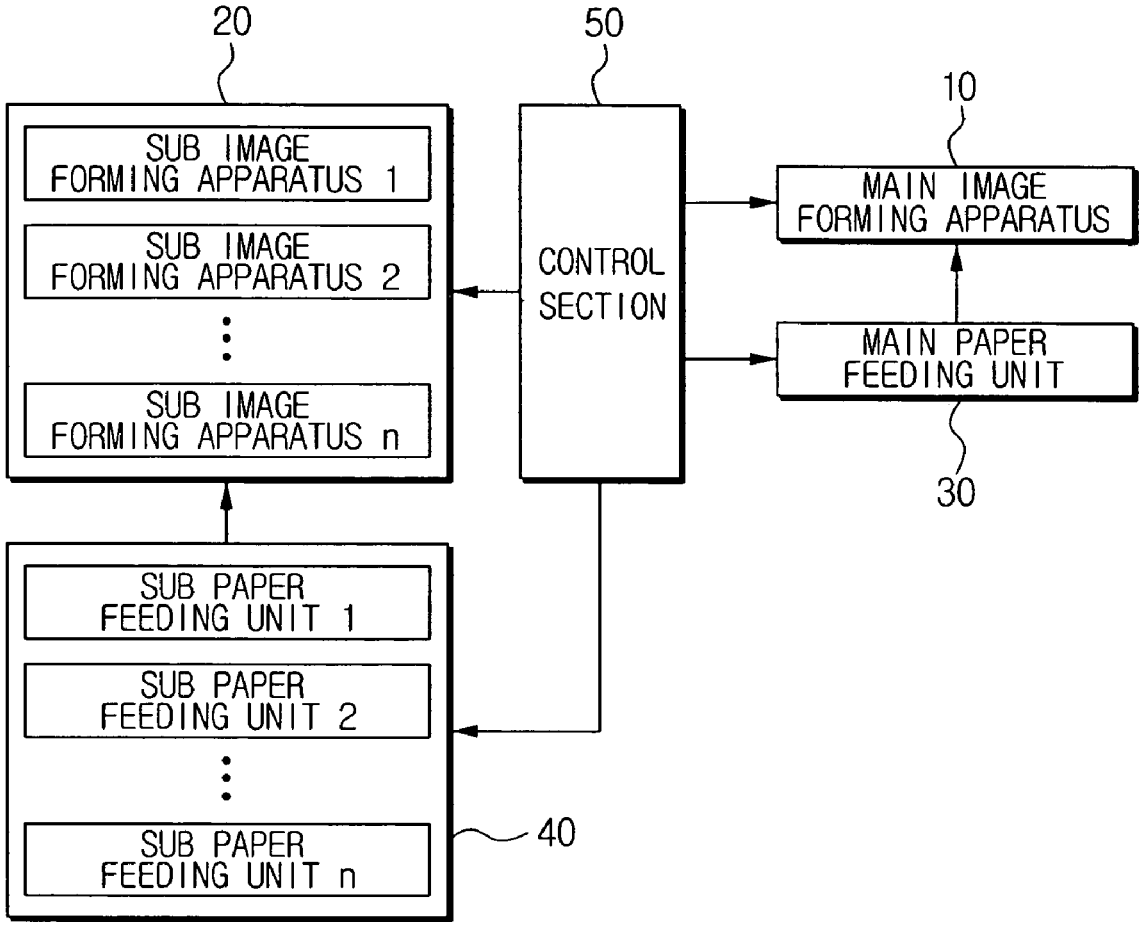
FIG. 1 is a block diagram for illustrating an image forming apparatus according to an embodiment of the present invention.
Figure 2:
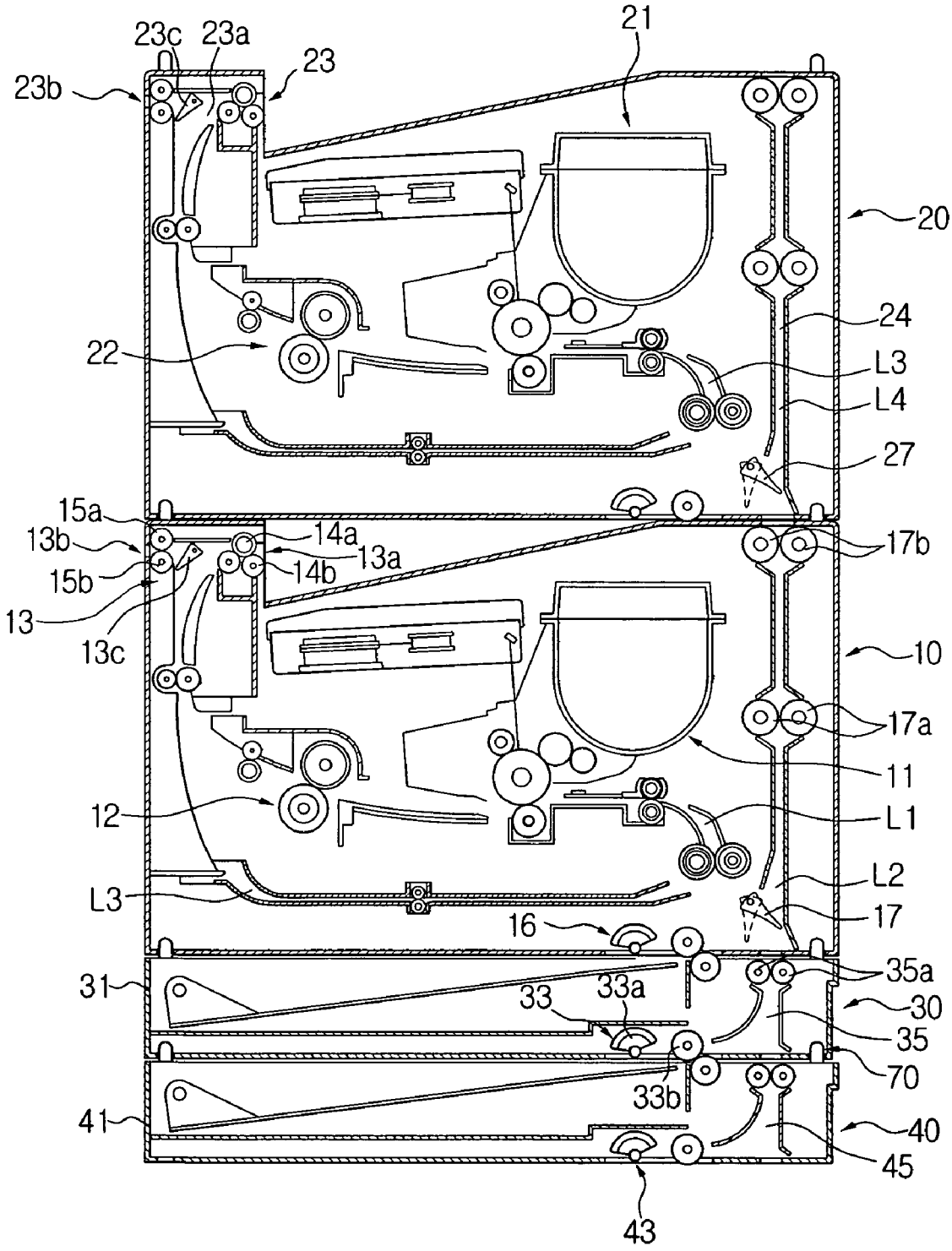
FIG. 2 is a sectional view of an image forming apparatus according to an embodiment of the present invention.

Referring to FIGS. 1 and 2, an image forming apparatus according to an embodiment of the present invention comprises a main image forming apparatus 10 provided with a developing section 11 for independently printing an image onto a paper, a sub-image forming apparatus 20 removably installed on the top of the main image forming apparatus 10, a main paper feeding unit 30 installed under the main image forming apparatus 10, at least one sub-paper feeding unit 40 connected to the bottom of the main paper feeding unit 30, and a control section 50.

As in a conventional laser printer, the main image forming apparatus 10 comprises a developing section 11 for forming an image on a paper, a fusing section 12 for fusing the developed image onto the paper using high pressure and high temperatures, and a discharge section 13 for discharging the paper that passed through the fusing section 12. The developing section 11 comprises an organic photoconductive (OPC) drum, a developing roller, a toner cartridge, and a laser scanning unit (LSU), which are well known in the art and thus a detailed description thereof will be omitted.

The discharge section 13 is divided into a first sub-discharge section 13*a* for discharging a paper in an upward direction with respect to the image forming apparatus 10 and a second sub-discharge section 13*b* for laterally discharging a paper, in which the sub-discharge sections 13*a*, 13*b* are equipped with paper discharge rollers 14*a* and 15*a* and idle rollers 14*b* and 15*b*, respectively. And, a guide member 13*c* is movably installed at the junction between the discharge sections 13*a* and 13*b*, which determines the transfer direction of a paper being fed. The guide member 13*c* can be driven by a solenoid (not shown) or the like, and the ON and OFF operation of the solenoid is controlled by the control section 50. Therefore, when the main image forming apparatus 10 is used with the sub-image forming apparatus 20 installed on the main image forming apparatus 10, the posture of the guide member 13*c* is determined so that a paper is discharged through the second sub-discharge section 13*b*. On the other hand, a lateral part of the main image forming apparatus 10 may be equipped with a paper stacker, within which papers discharged from the second discharge section 13*b* are loaded.

In addition, the main image forming apparatus 10 has a main transfer path L1 for transferring a paper fed to the main paper feeding unit 30, and a sub-transfer path L2 for guiding a paper fed from the sub-paper feeding unit 40 toward the sub-image forming apparatus 20.

The main transfer path L1 is arranged in such a way that a paper retrieved from the main paper feeding unit installed at the bottom of the main image forming apparatus 10 passes the developing section 11 and the fixing section 12. The main transfer path L1 is extended from a pick-up unit 16 provided at the bottom of the main image forming apparatus 10 to the discharge section 13 via the developing section 11 and the fusing section 12.

The sub-transfer path L2 is formed to pass through from the bottom surface to the top surface of the main image forming apparatus 10. This sub-transfer path L2 is part of a path for transferring a paper, which has been picked up in the sub-paper feeding unit 40 and passed through the main paper feeding unit 30, to the sub-image forming apparatus 20. A plurality of paper transfer rollers 17*a*, 17*b* may be provided on the sub-transfer path L2. The sub-transfer path L2 may be completely isolated from the main transfer path L1 in the main image forming apparatus 10 and perform an independent function. Whereas, as shown in the drawing, it is also possible to form the main transfer path L1 and the sub-transfer path L2 to diverge from each other and, the guide member 17 is movably installed at the junction between them, thereby determining the path of a paper as being transferred.

In addition, the main image forming apparatus 10 may further comprise a return path L3 in order to reverse a paper for double-sided printing. The return path L3 is connected to the main transfer path L1 in the discharge section 13 and connected to the upstream of the developing section 11, which is the main path transfer path L1. The main image forming apparatus 10 as constructed in this manner is subject to the control of the control section 50 over the general developing process.

The sub image forming apparatus 20 is stacked on the top of the main image forming apparatus 10. The sub-image forming apparatus 20 cannot independently perform printing. However, it is an appliance modularized in a manner that it can receive power and a control signal via the control section 50 and can be selectively operated when it is connected to the main image forming apparatus 10. If the sub-image forming apparatus 20 is stacked on the top of the main image forming apparatus 10, it is mechanically and electrically connected to the main image forming apparatus 10.

The sub-image forming apparatus 20 also comprises the same components for performing printing as the main image forming apparatus 10, except for the control section 50. More specifically, the sub-image forming apparatus 20 is provided with a developing section 21, a fixing section 22 and a discharge section 23. The discharge section 23 is constructed the same as that of the discharge section 13. The discharge section 23 is divided into a first sub-discharge section 23*a* and a second sub-discharge section 23*b*, and is provided with a paper guide member 23*c*, thereby performing a function with the discharge section 13.

The sub-image forming apparatus 20 is provided with paper for printing from the sub-paper feeding unit 40 rather than from the main paper feeding unit 30. For that purpose, first and second transfer paths L3 and L4 are provided in the sub-image forming apparatus 20. The first and second transfer paths L3 and L4 diverge from each other at the bottom of the image forming apparatus 20 and are connected to respective transfer papers in different directions. The first path L3 guides a paper transferred through the sub-transfer path L2 so that the paper passes through the developing section 21 and the fixing section 23 of the sub-image forming apparatus 20. The second transfer path L4 is formed to pass through the bottom and top of the sub-image forming apparatus 20. Therefore, if a second image forming apparatus (not shown) is installed on the top of the sub-image forming apparatus 20, it is possible to feed the paper, that has passed through the second transfer path L2, to the second sub-image forming apparatus by using the second transfer path L4. Here, a guide member 27 is movably installed at the junction between first and second transfer paths L3 and L4 for determining the transfer direction of a paper as being transferred. The guide member 27 changes its position while being driven by a solenoid (not shown). The ON and OFF drive of the solenoid is controlled by the control section 50.

As described above, at least one sub-image forming apparatuses 20 is sequentially stacked and installed on the top of the main image forming apparatus 10 in a modularized state. Therefore, because the sub-image forming apparatus 20 can perform a printing operation along with the main image forming apparatus 10, the printing speed can be enhanced.

Figure 3:
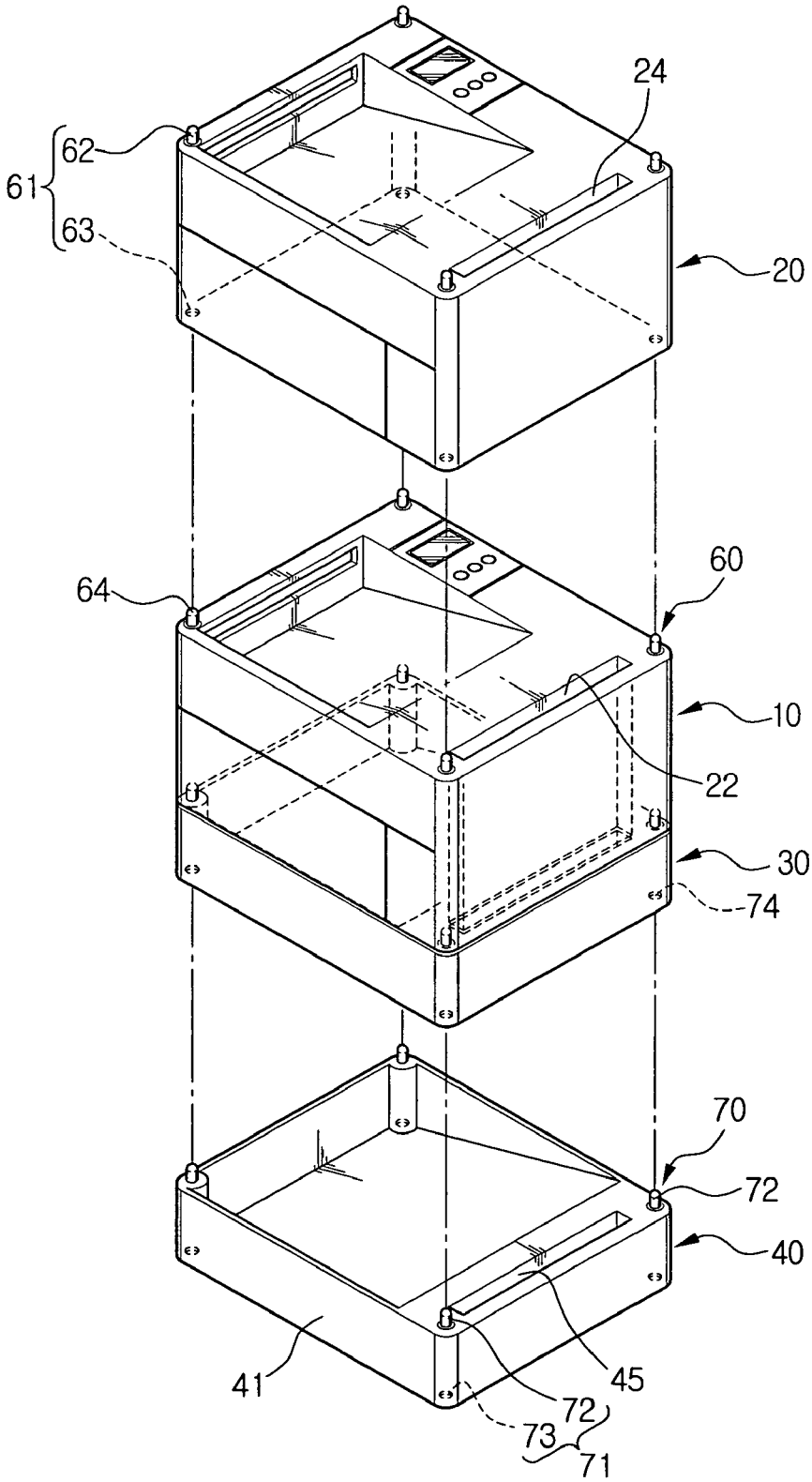
FIG. 3 is an exploded perspective view of the image forming apparatus according to another embodiment of the present invention.

A first alignment unit 60 is further provided for determining a connection position between the main image forming apparatus 10 and the sub-image forming apparatus 20, as shown in FIG. 3, when the at least one sub-image forming apparatuses 20 is stacked on the top of the main image forming apparatus 10 as described above. The first alignment unit 60 comprises a first positioning part 61 provided on the top and bottom surfaces of the image forming apparatus 20, and a second positioning part 64 provided in the neighboring image forming apparatus 10 to correspond to the first positioning parts 61. In an embodiment of the present invention, the first positioning part 61 comprises a plurality of positioning projections 62 formed on the top surface of the sub-image forming apparatus 20 and a plurality of positioning grooves 63 formed on the bottom surface of the sub-image forming apparatus 20. The second positioning part 64 comprises positioning projections formed on a neighboring image forming apparatus such as the main image forming apparatus 10. Therefore, if the image forming apparatuses 10 and 20 are assembled with each other so that the positioning projections of the second positioning part 64 are fitted into the positioning grooves 63, the sub-transfer path L2 and the second transfer path L4 are aligned and connected with each other. The positioning projections 62 provided on the top surfaces of the sub-image forming apparatus 20 are provided to align the transfer paths when another sub-image forming apparatus such as the second sub-image forming apparatus is connected to the sub-image forming apparatus 20.

Referring now to FIG. 2, the main paper feeding unit 30 basically forms a set with the main image forming apparatus 10, wherein the main paper feeding unit 30 is mounted under the main image forming apparatus 10. The main paper feeding unit 30 comprises a paper feeding tray 31 having a space for receiving papers, a pick-up unit 33 provided under the paper feeding tray 31 and a paper path 35 vertically formed through the pick-up unit 33 and the paper feeding unit 31. The pick-up unit 33 is provided at the bottom of the pick-up unit 33 in order to pick up a paper from a sub-paper feeding unit 40 selectively stacked and installed under the first paper feeding unit 30. The pick-up unit 33 comprises a pick-up roller 33*a* and a transfer roller 33*b*. The pick-up roller 33*a* may be driven by a pick-up motor (not shown) provided in a side of the paper feeding tray 31. The paper path 35 is vertically provided to pass through the paper feeding tray 31 separately from the paper receiving space in the paper feeding tray 31 and to be connected to the sub-transfer path L2. The paper path 35 is equipped with a transfer roller 35*a*. The transfer roller 35*a* may be driven by receiving driving force from a separate driving motor installed in the paper feeding tray 31, or from the motor of the pick-up roller 33*a*.

The sub-paper feeding unit 40 is provided in order to feed papers into the sub-image forming apparatus 20. The paper feeding unit 40 is also modularized and it is possible to sequentially install two or more such paper feeding units 40 under the main feeding unit 40. In an embodiment, one sub-paper feeding unit 40 is installed. The sub-paper feeding unit 40 has the same construction as the main paper feeding unit 30. The sub-paper feeding unit 40 also has a paper feeding tray 41, a pick-up unit 43 and a paper path 45. The paper path 45 is connected to the paper path 35 of the main paper feeding unit 30. A paper picked up from the paper feeding tray 41 of the sub-paper feeding unit 40 is transferred to the paper path 35.

Referring now to FIG. 3, a second alignment unit 70 is further provided for aligning the paper paths 35 and 45 at the time of assembly of the paper feeding units 30 and 40 constructed as described above. The second alignment unit 70 comprises a third positioning means 71 provided on the top and bottom surfaces of the sub-paper feeding unit 50, and a fourth positioning means 74 provided on a neighboring paper feeding unit to correspond to the third positioning unit 71. The third positioning means 71 comprises a plurality of positioning projections 72 provided on the top surface of the paper feeding tray 41 and a plurality of grooves 73 provided on the bottom surface of the paper feeding tray 41. In an embodiment of the present invention, the fourth positioning means 74 comprises positioning grooves provided on the bottom surface of the paper feeding tray 41 of the sub-paper feeding unit 40. Therefore, if the paper feeding units 30 and 40 are stacked so that the positioning projections 72 are fitted into the positioning grooves 74, the assembly is made while the paper paths 35 and 45 are aligned with each other.

By sequentially stacking the second, the third, and so on through the nth paper feeding units, which have the same construction as the sub-paper feeding unit in this manner, sufficient papers can be fed. It is also possible to control the position of the guide member 17 by means of the control section 50, in such a way that papers fed from the sub-paper feeding unit 40 will be fed only to the sub-image forming apparatus 20 and the papers fed from the main paper feeding unit 30 will be fed only to the main image forming apparatus 10.

In addition, an electrical connector is provided for electrically interconnecting the main image forming apparatus 10 and the main paper feeding unit 30 when a modularized image forming apparatus 20 and a sub-paper feeding unit 40 are additionally mounted as described above. The connector may comprise a conventional connection jack and a connection terminal, which are directly or indirectly connected with each other. Because such a construction is sufficiently applicable using a well-known technique, a detailed description thereof will be omitted.

The image forming apparatus constructed as described above according to an embodiment of the present invention is used in printing in the following manner:

The main image forming apparatus 10 and the main paper feeding unit 30 are basically assembled, thereby providing a single set. Depending on the user's convenience, the sub-image forming apparatus 20 and the sub-paper feeding unit 40 are assembled to the basically assembled set by using first and second alignment units 60 and 70 as shown in FIG. 3.

In this state, if printing data are input through a PC, the control section 50 determines whether to use both or only one of the main and sub-image forming apparatuses 10 and 20 in printing and then executes printing operations. The method for distributing printing data may be set either in advance or case by case through a driver of a PC.

For example, when it is intended to perform printing on a sheet of paper, the printing may be performed in a manner that the main paper feeding unit 30 feeds the paper, the main image forming apparatus 10 performs printing on the paper and then discharges the paper.

When it is required to perform printing on two or more sheets of papers, it is possible to render the printing quantity to be halved and then concurrently printed out from the respective image forming apparatuses 10 and 20. In that case, the printout speed can be increased to the maximum. Moreover, the above-mentioned type of printing mode can be controlled by the control section 50. Specifically, the control section 50 is provided in the main image forming apparatus 10, so that it can also control the sub-image forming apparatus 20 connected to the main image forming apparatus 10. Therefore, no separate control section is needed in the modularized sub-image forming apparatus 20.

Figure 4:
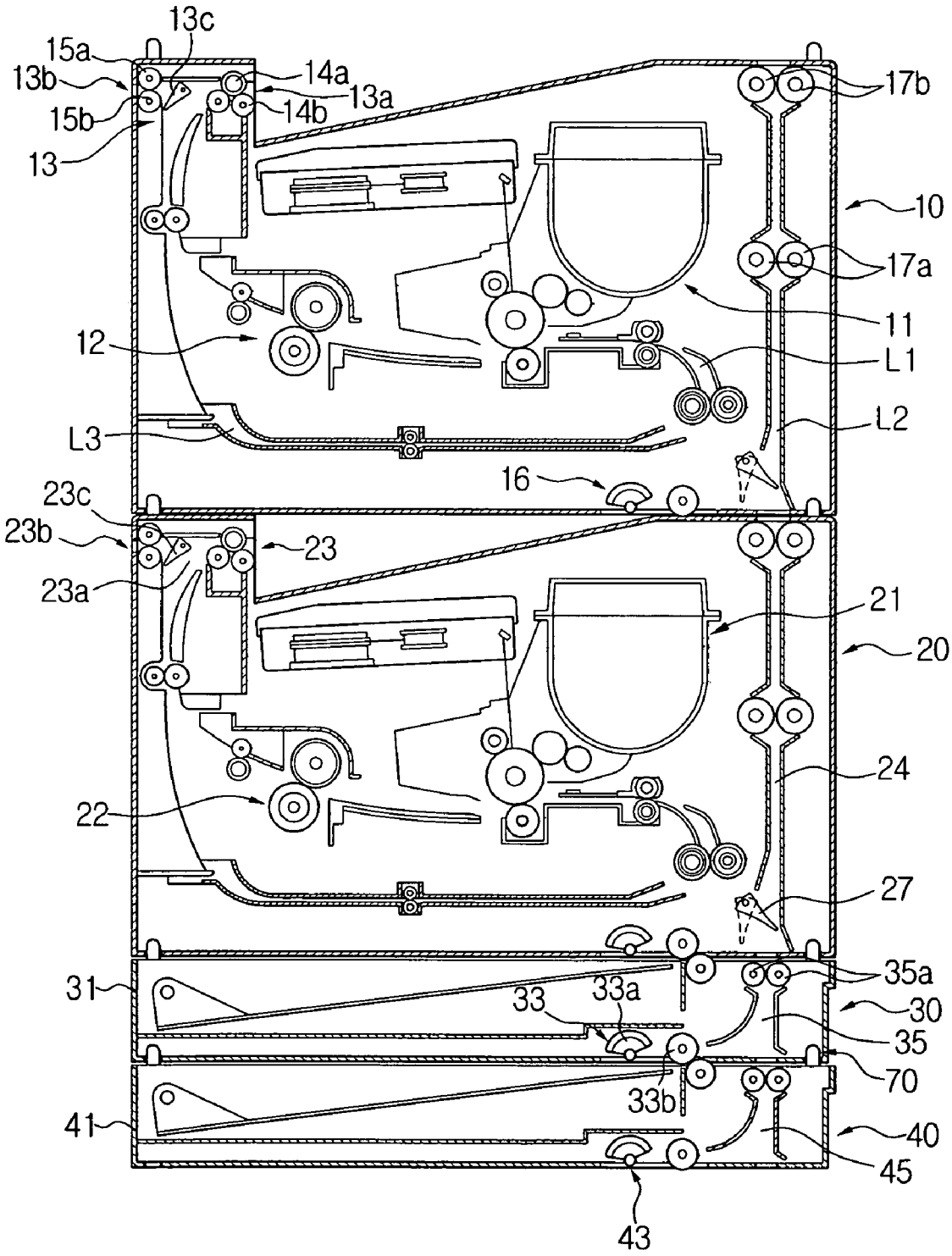
FIG. 4 is a sectional view of an image forming apparatus according to another embodiment of the present invention.

As another example of use according to an embodiment of the present invention, as shown in FIG. 4, the sub-image forming apparatus 20 can be stacked under the main image forming apparatus 10. In that case, because the main image forming apparatus is laid on top of the sub-image forming apparatus 20, a display panel is not required, which has been provided on the top of the sub-image forming apparatus 20. Therefore, the construction can simplified. In addition, the respective paper feeding units 30 and 40 are assembled so that they can be stacked under the sub-image forming apparatus 20. Although the sub-image forming apparatus 20 is installed between the paper feeding units 20 and 40, and the main image forming apparatus 10 in this manner, the printing operation will be equally executed. More specifically, a paper is fed from the main paper feeding unit 30 by the pick-up unit 26 of the sub-image forming apparatus 20, and then the fed paper may be selectively fed to the sub-image forming apparatus 20 or the main image forming apparatus 10 for printing.

As can be appreciated from the above description, it is possible to form main and sub-image forming apparatuses 10 and 20 so that they are mechanically the same, but a control section 50 is provided only in the main image forming apparatus 10 in such a manner that both of the forming appliances can be controlled by the control section 50. As a result, the image forming apparatus can be added at a low cost.

According to the image forming apparatus based according on an embodiment of the present invention, the modularized image forming apparatus and the paper feeding unit can be selectively connected to the main image forming apparatus and the main paper feeding unit, so that they concurrently perform printing operations. As a result, printout speed can be increased.

In addition, since an arrangement is provided in such a way a single control section is used in controlling two or more image forming apparatuses, the unit cost of production is reduced.

While the present invention has been shown and described with reference to certain embodiments thereof, the present invention is not limited to the embodiments. It should be understood that various modifications and changes can be made by those skilled in the art without departing from the spirit and scope of the invention as defined by the appended claims. Therefore, it should be appreciated that such modifications, changes and equivalents thereof are all included within the scope of the present invention.

What is claimed is:

1. An image forming apparatus comprising:

a main image forming apparatus having a developing section and capable of being independently driven for printing an image onto a paper fed on the basis of input image information;

at least one sub-image forming apparatus mounted to the main image forming apparatus in sequence, the sub image forming apparatus having a developing section and modularized to perform a printing operation according to a control command;

a main paper feeding unit connected to the main image forming apparatus for feeding a paper to the main image forming apparatus;

at least one sub-paper feeding unit connected to the main paper feeding unit in sequence for feeding a paper to the sub-image forming apparatus, respectively; and a control section for selectively controlling the operation of the main image and sub-image forming apparatuses and respective paper feeding units on the basis of input image information in a manner that printing operations are performed either in one of the main image or sub-image forming apparatus, or simultaneously in the respective main image and sub-image forming apparatuses;

wherein the main image forming apparatus comprises the control section;

wherein the at least one sub-image forming apparatus includes a first transfer path for guiding a paper fed from the sub-paper feeding unit, so that the paper passes through the developing section;

a second transfer path for transferring a paper fed from the sub-paper feeding unit to another sub-image forming apparatus; and a guide member disposed at a junction between the first transfer path and the second transfer path for selectively determining the transfer direction of the paper being transferred.

2. The apparatus according to claim 1, wherein the main image forming apparatus comprises a main paper path provided a predetermined distance from the developing section so that printing can be performed on a paper fed from the main paper feeding unit; and a sub-transfer path for guiding a paper fed from a sub-paper feeding unit for transfer to the sub-image forming apparatus.

3. The apparatus according to claim 2, wherein the sub-transfer path is provided to pass through the top and bottom of the main image forming apparatus.

4. The apparatus according to claim 1, wherein the sub-image forming apparatus is sequentially stacked on the top of the main image forming apparatus.

5. The apparatus according to claim 1, wherein the second transfer path is formed to pass through the upper and lower parts of the sub-image forming apparatus.

6. The apparatus according to claim 1, wherein the sub-paper feeding unit is sequentially stacked under the main paper feeding unit in sequence.

7. The apparatus according to claim 6, wherein the main paper feeding unit and sub-paper feeding unit respectively comprises a paper feeding tray having a paper receiving space loaded with papers;

a pick-up unit located at the bottom of the paper feeding tray for picking up a paper from the paper feeding unit installed at a relatively lower position; and a paper path vertically connected to the paper feeding tray to guide a paper picked up from the paper feeding tray located at the relatively lower position.

8. The apparatus according to claim 7, wherein the paper path is connected to the sub-transfer path of the main image forming apparatus.

9. The apparatus according to claim 1, further comprising a first alignment unit for determining a connection position between the sub-image forming apparatus and a predetermined neighboring image forming apparatus; and a second alignment unit for determining a connection position between the sub-paper feeding unit and a predetermined neighboring paper feeding unit.

10. Then apparatus according to claim 9, wherein the first alignment unit comprises a first positioning part formed to be prominent or depressed on the top and bottom surfaces of the sub-image forming apparatus; and a second positioning part formed to be prominent or depressed on the top and bottom surfaces of a predetermined image forming apparatus connected to the sub-image forming apparatus so that it can be complimentarily engaged with the first position part.

11. The apparatus according to claim 9, wherein the second alignment unit comprises:

a third positioning part formed be prominent or depressed on each of the top and bottom surfaces of the sub-paper feeding unit; and a fourth positioning part formed to be prominent or depressed on the top or bottom surface of a predetermined paper feeding unit connected to the sub-paper feeding unit so that it can be complimentarily engaged with the third positioning part.

12. The apparatus according to claim 1, wherein the sub-image forming apparatus is stacked in sequence under the main image forming apparatus.

13. The apparatus according to claim 1, wherein the control section controls the operation over the entire developing process, and the sub-image forming apparatus is controlled by the control section of the main image forming apparatus.

14. A method for simultaneously performing a plurality of printing operations using a plurality of developing sections, the method comprising independently driving a main image forming apparatus having the developing section for printing an image onto a paper fed on the basis of input image information;

mounting at least one sub-image forming apparatus to the main image forming apparatus in sequence, the sub image forming apparatus having the developing section and being modularized to perform a printing operation according to a control command;

feeding a paper to the main image forming apparatus via a main paper feeding unit connected to the main image forming apparatus;

connecting at least one sub-paper feeding unit to the main paper feeding unit in sequence for feeding a paper to the sub image forming apparatus, respectively;

selectively controlling, via a control section for the main image forming apparatus, the operation of the main image and sub-image forming apparatuses and the respective paper feeding units on the basis of input image information in a manner that printing operations are performed either in one of the main image or sub-image forming apparatus, or simultaneously in the respective image forming apparatuses;

guiding a paper fed from the sub-paper feeding unit so that the paper passes through the developing section via a first transfer path;

transferring a paper fed from the sub-paper feeding unit to another sub-image forming apparatus via a second transfer path; and selectively determining the transfer direction of the paper being transferred with a guide member disposed at a junction between the first transfer path and the second transfer path.

15. The method according to claim 14, further comprising:

providing a main paper path a predetermined distance from the developing section so that printing can be performed on a paper fed from the main paper feeding unit; and guiding a paper fed from a sub-paper feeding unit along a sub-transfer path for transfer to the sub-image forming apparatus.

16. The method according to claim 15, wherein the sub-transfer path is provided to pass through the top and bottom of the main image forming apparatus.

17. The method according to claim 14, wherein the sub-image forming apparatus is sequentially stacked on the top of the main image forming apparatus.

18. The method according to claim 14, wherein the second transfer path is formed to pass through the upper and lower parts of the sub-image forming apparatus.

19. The method according to claim 14, wherein the sub-paper feeding unit is sequentially stacked under the main paper feeding unit in sequence.

20. The method according to claim 19, further comprising:

receiving space loaded with papers via a paper feeding tray having a paper;

picking up a paper from the paper feeding unit installed at a relatively lower position via a pick-up unit located at the bottom of the paper feeding tray for; and guiding a paper picked up from the paper feeding tray located at the relatively lower position via a paper path vertically connected to the paper feeding tray.

21. The method according to claim 20, wherein the paper path is connected to the sub-transfer path of the main image forming apparatus.

22. The method according to claim 14, further comprising determining a connection position between the sub-image forming apparatus and a predetermined neighboring image forming apparatus via a first alignment unit; and determining a connection position between the sub-paper feeding unit and a predetermined neighboring paper feeding unit via a second alignment unit.

* * * * *